United States Patent [19]

Feess et al.

[11] 4,242,091

[45] Dec. 30, 1980

[54] PROCESS FOR THE CONTINUOUS DYEING OF TEXTILE WEBS PRE-HEATED WITH INFRA-RED OR MICRO-WAVES

[75] Inventors: Erich Feess, Hofheim am Taunus; Walter Birke; Joachim Steinbach, both of Frankfurt am Main, all of Fed. Rep. of Germany

[73] Assignee: Hoechst Aktiengesellschaft, Frankfurt, Fed. Rep. of Germany

[21] Appl. No.: 103,869

[22] Filed: Dec. 14, 1979

Related U.S. Application Data

[63] Continuation of Ser. No. 862,664, Dec. 21, 1977, abandoned.

[30] Foreign Application Priority Data

Dec. 24, 1976 [DE] Fed. Rep. of Germany ..... 2658863
Mar. 25, 1977 [DE] Fed. Rep. of Germany ..... 2713166

[51] Int. Cl.[3] ..... D06P 5/20; D06P 3/60; D06P 3/14

[52] U.S. Cl. ..... 8/444; 8/149.3; 8/529; 8/652

[58] Field of Search ..... 8/2, 1 A, 37, 54, 54.2, 8/149.3

[56] References Cited

U.S. PATENT DOCUMENTS

| | | | |
|---|---|---|---|
| 2,206,611 | 7/1940 | Lantz | 8/2 |
| 3,724,997 | 4/1973 | von der Eltz | 8/2 |
| 3,932,129 | 1/1975 | Porter | 8/176 |

FOREIGN PATENT DOCUMENTS

| | | |
|---|---|---|
| 811946 | 8/1951 | Fed. Rep. of Germany . |
| 1124787 | 8/1968 | United Kingdom . |

*Primary Examiner*—A. Lionel Clingman
*Attorney, Agent, or Firm*—Curtis, Morris & Safford

[57] ABSTRACT

Process for the continuous dyeing of textile webs made from cellulose fibers or wool, or mixtures containing such fibers, with reactive or sulfur dyestuffs in reduced form, or with reactive or acid dyestuffs, which comprises preheating the textile material to temperatures of from 97° to 104° C. by means of IR radiators or microwaves while maintaining a residual moisture corresponding at least to the water retention amount (normal humidity) of the fibers, and subsequently treating it with steam for 10 to 300 seconds without applying additional pressure, in order to fix the dyestuffs.

7 Claims, No Drawings

PROCESS FOR THE CONTINUOUS DYEING OF TEXTILE WEBS PRE-HEATED WITH INFRA-RED OR MICRO-WAVES

This is a continuation of application Ser. No. 862,664, filed Dec. 21, 1977, now abandoned.

Fixation of dyestuffs padded or printed on textiles made from natural, regenerated or synthetic fibers by a continuous process has been known for a long time. In this process, the dyestuffs to be fixed are applied onto the textile webs in the form of liquors, that is, solutions or dispersions, or in the form of printing pastes, optionally with the aid of necessary fixation chemicals. On the other hand, these fixation chemicals may be applied separately from the dyestuff liquor or printing paste in a second padding operation. Subsequently, the material, with or without intermediate drying, is forwarded to a continuous steamer where it is exposed to a steam atmosphere of about 100° C. in order to fix the dyestuff (conventional pad/steam process). In all these cases the textile material is at room temperature before entering the steamer, that is, it has a temperature considerably below the steaming temperature, so that condensation of steam occurs and thus local dilution of the liquor especially on the surface of the material (nearly not at all in the interior). The consequences are: frosting effect (less intense dyed fiber ends especially in the case of cellulose or wool fabrics), so-called sooty aspect and possibly also dyestuff migration in the course of the normal steaming process combined with reduced dyestuff yields.

In German Auslegeschrift No. 1,086,203, a process has been described for dyeing textile webs at temperatures of more than 100° C. In this process, after impregnation with a dyestuff solution and squeezing-off of excess moisture, the web is heated to about 95° C. in a heating channel arranged before a pressure chamber, and subsequently wound up on a batching roller mounted in the cited pressure chamber. After having closed the chamber, the material is heated to the intended dyeing temperature by means of direct steam, while unwinding it from the above roller and rewinding it on a second roller being also present in the chamber. While maintaining the adjusted temperature (110° to 134° C.) and the corresponding pressure (1.5 to 3 atm/gge.), this latter roller remains in the chamber for a period of time which is sufficient for fixing the dyestuff. In accordance with this discontinuous operation mode, fixation of the dyestuffs is carried out by means of steam having a defined moisture content. Adjustment of this defined steam, however, is extremely difficult in the industrial practice, for there is always the risk of uncontrolled condensation in this kind of process. On the contrary, when the partial pressure of the steam becomes too low because of addition of air, there is the risk of the applied liquor to dry on the textile material and thus of dyestuff migration to be caused.

German Auslegeschrift No. 1,610,951 describes also a discontinuous dyeing and fixation process according to which the textile material padded with the dyestuff is forwarded in the form of a web to a roller in a treating chamber having an over-pressurized steam atmosphere, so that it is thus heated to fixing temperature, in which chamber it is wound up and exposed in wound-up state to the steam atmosphere for a further period of time. According to the operation mode so proposed, heating of the textile web starts immediately on entry into the treating chamber. This state of the art prescribes treatment of the goods under a pressure of up to 5 atm/gge., which requires the use of pressure vessels provided with complicated sealing devices (roller locks).

In the case of dyeing with sulfur dyestuffs, soluble or not, all these processes have a serious disadvantage which hitherto could be overcome only by intermediate drying, especially when mercerized cotton and regenerated cellulose is to be dyed. Without such intermediate drying, the dyeings have an inhomogeneous, sooty surface, and the color penetration into the fibrous material is often insufficient. Addition of levelling and anti-migration agents does not give the intended results in this case, it only raises the cost of the dyeing operation.

The present invention provides a process for the continuous dyeing of textile webs made from cellulose fibers or wool, or mixtures containing such fibers, with reactive or sulfur dyestuffs in reduced form, or with reactive or acid dyestuffs, the textile material, impregnated with the aqueous liquor or printed with the aqueous printing paste, being preheated just before entering the zone of steam treatment, which comprises preheating the textile material to temperatures of from 97° to 104° C. by means of IR radiators or microwaves while maintaining a residual moisture corresponding at least to the water retention amount (normal humidity) of the fibers, and subsequently treating it with steam for 10 to 300 seconds without applying additional pressure, in order to fix the dyestuffs.

The process of the invention allows level dyeing of the cited fibrous materials with the above dyestuffs according to a one-bath/steaming process without losses in yields due to the actual state-of-the-art conditions. Thus, the migration problems arising because of the omitted intermediate drying are solved, so that the operation mode of the invention is considerably more economic than the hitherto known processes. The preheating step causes the liquor applied to attain a temperature near its boiling point, while the temperature separation from that of the steaming step is kept as low as possible (generally, it should not be in excess of 5° C.). Because of this intense heat treatment, inevitably part of the water contained in the dyeing liquor on the goods evaporates, which portion is small due to the short period of time, so that the moisture losses within the IR preheating zone are limited. The residual moisture of the textile material, however, must not drop below the water retention amount for the fiber during the preheating and the further treatment (according to Fischer-Bobsien, Internationales Lexikon Textilveredelung und Grenzgebiete, 4th edition (1975), the swelling value corresponds to the water retention power, that is, percentage of water held back relative to weight of dry fibers). By the reduction of the liquid amount, a deposit of condensate onto the moist goods on entry into the steamer is avoided and thus also the abovementioned consequences. Therefore, a reduction of the goods-to-liquor ratio results and thus a considerable increase of dyestuff yield. Under the contions of the invention, the liquor penetrates uniformly into the whole fabric, that is, projecting fiber ends. The invention ensures that the steam treatment does not cause dilution of the liquor and thus wash-out from the fiber ends, so that there is no undesirable frosting effect on the goods dyed in accordance with this invention. In the case of undernips, on account of a certain isolation of these relatively small fiber amounts, in the usual processes water is deposited in a smaller amount than on the normal surface of the fabric, so that undernips generally are dyed in a darker shade than the surrounding areas. This undesirable effect is also suppressed by means of the present invention. The positive influence of the new method is greater the higher the affinity of the dyestuff and the textile material to each other. Therefore, it is more distinct in the case of mercerized fabrics than in the case of non-mercerized goods.

In contrast to German Auslegeschrift No. 1,086,203, according to which the dyestuff fixation is carried out by means of steam having an exactly defined moisture content, the intended object is achieved in accordance with this invention without any difficulty, for the operation principle of the invention excludes the numerous imponderables involved in the condensation of steam. As compared to the state of the art according to German Auslegeschriften Nos. 1,086,203 and 1,610,951, only a fraction of the periods of time indicated therein is required for the dyeing in accordance with the present invention, because the new process is fully continuous. As compared to the known operation modes as indicated above, the superiority of the process of the invention resides moreover in the fact that the dyestuffs can be fixed without applying additional pressure, so that special pressure apparatus is no longer required, and steam having a pressure of about 4 bars which is generally at disposal in many industrial plants may therefore be used directly, thus reducing costs.

As already mentioned before, drying of the material padded with the dyestuff must strictly be avoided for the process of this invention. This may be ensured in a simple manner via the heating power and the conveying speed of the textile web. By a compact construction of the heating zone and a short distance between foulard and steamer—the IR radiators being mounted before the inlet of the latter one—the risk of drying after the squeezing step is considerably reduced. The limited decrease of moisture by 15 to 50% allowed by the new process—that is, the initially absorbed amount of liquid is reduced to 50% at most—avoids local drying. A wick-like effect of the textile material does not occur, so that there is no migration of the dyestuff either.

According to the process of the invention, the liquor on the textile material must be heated to practically 100° C. by means of IR radiation. At this temperature, only an insignificant condensation, if any, occurs in the steaming zone. Less heating would result in a dilution of the liquor and thus adversely affect the dyeings.

The steaming process for fixing the dyestuffs which follows the preheating of the textiles padded or printed with the dyestuffs may be carried out by blowing steam of 100° to 150° C. onto the continuously conveyed textile material in a zone of normal pressure, for example on a stenter, or it is carried out in a continuous steamer at temperatures of from 102° to 150° C.

The process of the invention is above all provided for the fixation of reactive dyestuffs on cellulose fibers or mixtures thereof with, preferably, polyester fibers. In principle, the process of the invention allows also to fix corresponding reactive dyestuffs and even acid dyestuffs on wool.

Suitable reactive dyestuffs for the process of the invention are especially those which contain at least one group capable of reacting with polyhydroxyl fibers, a precursor thereof, or a substituent capable of reacting with the polyhydroxyl fiber. Suitable parent substances of the organic dyestuffs are especially those of the series of azo, anthraquinone and phthalocyanine dyestuffs; the azo and phthalocyanine dyestuffs optionally containing metals or not. By reactive groups and their precursors which form such groups in an alkaline medium, there are to be understood for example epoxy groups, the ethylene-imide group, the vinyl group in a vinylsulfone group or in the acrylic acid radical, the β-sulfatoethylsulfone or β-chloroethylsulfone group. Furthermore, derivatives of the tetrafluorocyclobutyl series, for example of tetrafluorocyclobutylacrylic acid, may be used. Reactive substituents in reactive dyestuffs are for example those which are easily split off and leave an electrophilic radical. Examples of such substituents are halogen atoms at the following ring systems: quinoxaline, triazine, pyrimidine, phthalazine and pyridazone. Dyestuffs containing several different reactive groups may also be used.

Suitable acid dyestuffs for the dyeing of wool are anionic dyestuffs, and also those dyestuffs which behave as acid dyestuffs in an acidic medium.

Furthermore, there may be used as dyestuffs for the process of the invention all sulfur dyestuffs and vat dyestuffs, that is, all dyestuffs indicated in the Colour Index, 3rd edition (1971), vol. 3, under the following denominations: Sulphur Dyes, Leuco Sulphur Dyes, Solibilised Sulphur Dyes and Vat Dyes. The choice of the reducing agent to be used is not limited and depends only on the suitable dyestuff combination. There may be used for example: sodium sulfide, sodium hydrogen sulfide/soda, sodium dithionite/sodium hydroxide solution; glucose/sodium hydroxide solution.

It was surprising for the expert to oberseve that dyeings with sulfur dyestuffs obtained according to the new process without any additional operations impart to the textile material an improved aspect which could not be attained hitherto, so that sulfur dyestuffs may now be applied without intermediate drying and special additives also in the case of high-quality fabrics. Simultaneously, these dyeings show a penetration more deeply into the fabric, which means that, at identical color depth of the dyeing, an improvement of the color yield amounting to 10–15% is attained. It is especially advantageous that now a process is provided for the so-called blended fabrics which avoids the complicated an unreliable mixing of sulfur and disperse dyestuffs, without requiring additional operations.

The following examples illustrate the invention; the amounts of dyestuffs and additives thereof are calculated on commercial products of usual formulation.

EXAMPLE 1

A bleached, mercerized cotton fabric having an area weight of 106 g/m$^2$ is padded on a foulard at room temperature with a liquor pick-up of 54% (relative to the weight of the dry goods) using an aqueous liquor which contains per liter 25 g of the reactive dyestuff of the formula

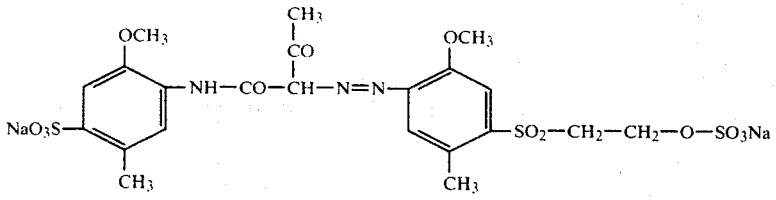

25 g of the reactive dyestuff of the formula

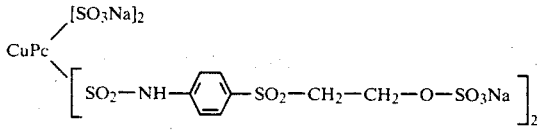

(CuPc = copper phthalocyanine)
30 g of sodium sulfate (anhydrous) and
22 $cm^3$ sodium hydroxide solution, 32.5% strength.

Subsequently, the following parts of the goods so padded:
(a) one part without IR preheating
(b) another part with IR preheating at 100° C., containing 30% of residual moisture (relative to the weight),
are introduced into a steamer without applying additional pressure, where steam of 140° C. is blown onto the goods for 1 minute. Brilliant green dyeings are obtained in both cases, the color yield of which is calculated as being 100% in the case of (a) without IR preheating, while it amounts to 125% of the value of (a) in the case of (b) with IR preheating.

EXAMPLE 2

As described in Example 1, a cotton fabric is treated with
28 g/l of the reactive dyestuff Reactive Orange 16, C.I. No. 17,757
4 g/l of the reactive dyestuff of the formula

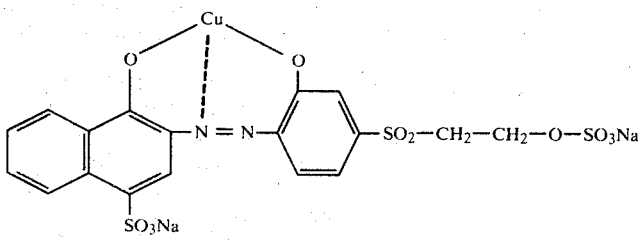

17 g/l of the reactive dyestuff of the formula

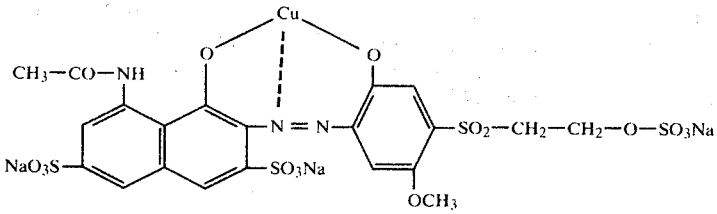

and subsequently steamed in the same manner (a) without and (b) with IR preheating.

Red dyeings are obtained in both cases, the color yield of which is calculated as being 100% for (a) without IR preheating, while it amounts to 130% in the case of (b) with preheating and containing 37% (of the weight) of residual moisture.

The padding liquors used in the above Examples 1 and 2 may optionally contain an added amount of 1 to 3 g/l of an anionic wetting agent on the basis of alkylsulfonates.

EXAMPLE 3

Dyeing operations are as in Example 1; however, 15 g/l of the dyestuff Reactive Blue 19, C.I. No. 61,200 are used in the alkaline padding liquor, and the padded material is preheated (100° C.) before steaming, thus obtaining a residual moisture of 9% (of the weight), which corresponds approximately to the swelling water content of the fiber.

A brilliant blue dyeing with optimum color yield is obtained.

EXAMPLE 4

A cotton twill fabric is padded with an aqueous padding liquor having a temperature of 30° C. and containing per liter:
70 g of the dyestuff Solubilised Sulphur Brown 16, C.I. No. 53,286
50 g of a 21% aqueous sodium hydrogen sulfide solution
10 g of calc. soda,
5 $cm^3$ of a 15% aqueous solution of a sodium polysulfide having an average S content of 2 to 5 atoms per molecule, and
3 g of an anionic wetting agent on the basis of alkanesulfonate.

After padding with a liquor pick-up of 70% (of the weight of the dry goods), the fabric is preheated in an IR channel to 100° C., whereby the residual moisture decreases to 50% (of the weight), and subsequently it is steamed for 60 seconds by blowing with steam of 140°

C. and without applying additional pressure. The goods so dyed are after-treated as usual by rinsing with water, acidic oxidation, repeated rinsing with water and neutral soaping. A full brown dyeing of the twill is obtained and an extremely uniform aspect of the goods.

COMPARATIVE TEST

When the above dyeing is carried out using the same padding liquor and operating according to the usual pad/steam process, but without infrared preheating, while steaming at 105°–107° C., a dyeing is obtained which has a distinctly poorer aspect. The color penetration into the textiles is poorer, too.

EXAMPLE 5

A cotton poplin for overcoats is padded with 75% by weight liquor pick-up using an aqueous liquor having a temperature of 25° C. and containing:

60 g/l of Sulphur Red, C.I. No. 53,720
18 g/l of Sulphur Brown 52, C.I. No. 53,320
8 g/l of Sulphur Black 1, C.I. No. 53,185
60 g/l of sodium sulfide (conc. sodium sulfide)
5 $cm^3$ of a 15% aqueous solution of a sodium polysulfide having 2 to 5 S atoms per molecule on the average, and
3 g/l of an anionic wetting agent on the basis of alkanesulfonate.

After padding, and immediately before steaming, the textile material is heated to 100° C. in an infrared channel, where the residual moisture is decreased to 40% (of the weight), and subsequently steamed for 1 minute without applying additional pressure. The goods are after-treated as usual by rinsing with water, acidic oxidation, repeated rinsing, soaping and another rinsing.

A uniform brown dyeing with high color yield of the poplin is obtained. The aspect of the goods is distinctly improved as compared to an identical dyeing obtained according to the normal pad/steam process. The dyestuff penetrates well, and the color yield is increased by 10 to 15%.

EXAMPLE 6

A cotton fabric is padded with a liquor pick-up of 65% by weight using an aqueous liquor having a temperature of 20° C. and containing 80 g/l of Leuco Sulphur Green 9, C.I. No. 53,005
40 g/l of Leuco Sulphur Brown 51, C.I. No. 53,327,
5 $cm^3$/l of a 15% aqueous solution of a sodium polysulfide containing on the average 2 to 5 S atoms per molecule, and
5 $cm^3$/l of an anionic wetting agent on the basis of alkanesulfonate.

After padding, the goods are heated to 100° C. in an infrared channel, whereby the residual moisture is reduced to 45% (of the weight), and subsequently steamed for 2 minutes without applying additional pressure. After rinsing with water, acidic oxidation and soaping, an olive dyeing is obtained which is distinguished by an absolutely uniform aspect and better penetration, as compared to a normal pad/steam dyeing.

EXAMPLE 7

A cotton twill is padded with a padding liquor having a temperature of 25° C., and containing per liter:

50 g of Vat Blue 43, C.I. No. 53,630
10 g of Sulphur Black 11, C.I. No. 53,290
115 $cm^3$ of a 21% aqueous sodium hydrogen sulfide solution
8 $cm^3$ of a 15% aqueous solution of a sodium polysulfide containing on the average 2 to 5 S atoms per molecule,
20 g of calc. soda, and
3 g of an anionic wetting agent on the basis of alkanesulfonate.

The material is padded with a liquor pick-up of 80% by weight, subsequently heated to 100° C. in an infrared channel, thus reducing the residual moisture to 15% (of the weight), and then steamed at 105° C. without applying additional pressure in a steamer for 4 minutes. Subsequently, the material is rinsed with water, subjected to acidic oxidation, rinsed again, soaped and rinsed until it is clear, as is usual.

A level navy blue dyeing having an excellent aspect and good penetration is obtained.

What is claimed is:

1. In a process for a continuous dyeing with a reactive or an acid dyestuff, wool or mixtures containing such fibers, as a textile web, or with a reactive or a sulfur dyestuff in reduced form, cellulose or mixtures containing such fibers, as a textile web, said textile web first having been impregnated with an aqueous liquor or printed with an aqueous printing paste containing said dyestuff, the improvement comprising preheating the textile web to temperatures from 97° to 104° C. by means of infrared waves or microwaves while maintaining a residual moisture content corresponding to at least the water retention content (at normal humidity) of said fibers during said preheating, and subsequently, while said fibers are at about said residual moisture content, in order to fix said dyestuff, treating said textile web with steam for 10 to 300 seconds without applying additional pressure.

2. The process as claimed in claim 1, which comprises carrying out the steam treatment at temperatures of from 100° to 150° C. in a zone of normal pressure.

3. The process as claimed in claim 1, which comprises carrying out the steam treatment at temperatures from 102° to 150° C. in a continuous steamer.

4. The process as claimed in claim 1, which comprises treating the material with steam for 20 to 60 seconds.

5. The process as claimed in claim 1, which comprises using prevatted sulfur dyestuffs.

6. The process as claimed in claim 1, which comprises using water-soluble sulfur dyestuffs.

7. The process as claimed in claim 1, which comprises using sulfur vat dyestuffs.

* * * * *